US007363839B2

(12) United States Patent
Chiang

(10) Patent No.: US 7,363,839 B2
(45) Date of Patent: Apr. 29, 2008

(54) DRIVING TOOL HAVING ROTATABLE COUPLING

(75) Inventor: Wen Hung Chiang, Taichung Hsien (TW)

(73) Assignee: Hsin Ying Enterprise Co., Ltd., Wantien Tsuen, Dadu Hsiang, Taichung Hsien (TW)

( * ) Notice: Subject to any disclaimer, the term of this patent is extended or adjusted under 35 U.S.C. 154(b) by 0 days.

(21) Appl. No.: 11/710,646

(22) Filed: Feb. 23, 2007

(65) Prior Publication Data

US 2008/0034929 A1 Feb. 14, 2008

Related U.S. Application Data

(63) Continuation-in-part of application No. 11/499,130, filed on Aug. 3, 2006.

(51) Int. Cl.
*B25B 23/16* (2006.01)

(52) U.S. Cl. ..... 81/177.75; 81/177.1; 81/177.7; 81/177.85

(58) Field of Classification Search ..... 81/177.1, 81/177.7, 177.75, 177.85
See application file for complete search history.

(56) References Cited

U.S. PATENT DOCUMENTS

| | | | | |
|---|---|---|---|---|
| 5,918,512 | A | 7/1999 | Habermehl et al. | 81/438 |
| 6,105,473 | A * | 8/2000 | Huang | 81/177.75 |
| 6,290,606 | B1 | 9/2001 | Hodson | 464/159 |
| 6,347,564 | B1 * | 2/2002 | Ciocca | 81/177.8 |
| 6,729,211 | B1 * | 5/2004 | Snow | 81/177.75 |
| 7,000,509 | B2 * | 2/2006 | Shiao | 81/490 |
| 7,018,298 | B1 * | 3/2006 | Chiou | 464/159 |

* cited by examiner

*Primary Examiner*—Joseph J. Hail, III
*Assistant Examiner*—Shantese L McDonald
(74) *Attorney, Agent, or Firm*—Charles E. Baxley

(57) ABSTRACT

A driving tool includes a tool stem having a non-circular spatial engaging member and having one or more flat surfaces, a tool shank having a non-circular socket opening and having one or more curved surfaces for pivotally receiving the spatial engaging member of the tool stem and for allowing the tool shank to be selectively tilted relative to a longitudinal axis of the tool stem. A control ferrule is slidably engaged onto the tool shank and slidable and engageable onto the tool stem for retaining the tool shank in line with the longitudinal axis of the tool stem and for preventing the tool shank from being tilted relative to the tool stem to other angular position.

2 Claims, 5 Drawing Sheets

DRIVING TOOL HAVING ROTATABLE COUPLING

The present invention is a continuation-in-part of U.S. patent application Ser. No. 11/499,130, filed 3 Aug. 2006, pending.

BACKGROUND OF THE INVENTION

1. Field of the Invention

The present invention relates to a driving tool, and more particularly to a driving tool having a rotatable coupling device for rotatably connecting or coupling a tool shank or a fastener or a work piece or a driven member to a tool stem and for allowing the tool shank or the fastener or the work piece or the driven member to be selectively secured to the tool stem and or to be rotated or driven by the tool stem or to be selectively tiltable or slantable relative to the tool stem and rotatable by the tool stem.

2. Description of the Prior Art

Typical driving tools, such as the wrenches or screwdrivers may comprise a tool member or a tool bit or a fastener or a work piece secured to a mandrel and arranged to allow the tool bit or the fastener to be selectively secured to the mandrel and rotated in concert with the mandrel or to be tiltable or slantable relative to the mandrel.

For example, U.S. Pat. No. 5,918,512 to Habermehl et al. discloses one of the typical replaceable bit screwdriver assemblies comprising a tool bit secured to a mandrel and arranged to allow the tool bit to be selectively secured to the mandrel and rotated in concert with the mandrel or to be tiltable relative to the mandrel. However, an additional lever tool is required to be engaged into the mandrel to selectively disengage the tool bit from the mandrel, such that the screwdriver assembly may not be easily operated by the users.

U.S. Pat. No. 6,290,606 to Hodson discloses another typical polygonal ball drive systems for earth auger and also comprising an earth auger selectively coupled or attached to a drive member with a number of balls. However, the earth auger may not be selectively and solidly coupled or attached to the drive member to allow the earth auger to be rotated in concert with or to be rotated or driven by the drive member.

The present invention has arisen to mitigate and/or obviate the afore-described disadvantages of the conventional driving tools.

SUMMARY OF THE INVENTION

The primary objective of the present invention is to provide a driving tool for connecting a tool member or a fastener or a work piece or a driven member to a tool stem and for allowing the tool member or the fastener or the work piece or the driven member to be selectively secured to the tool stem and to be driven by the tool stem or to be selectively tiltable or slantable relative to the tool stem to various angular positions, and to allow the tool stem to be rotated or driven or worked or operated in tiny or narrower working spaces.

In accordance with one aspect of the invention, there is provided a driving tool comprising a tool stem including an extension extended from a first end thereof, and a non-circular spatial engaging member provided on a second end thereof and having at least one flat surface formed therein, and including a peripheral depression formed between the tool stem and the spatial engaging member for forming a neck portion which includes an outer diameter smaller than that of the tool stem and the spatial engaging member, a handle including a receiving cavity formed therein for selectively receiving the extension of the tool stem, a spring-biased projection device engaged in the extension of the tool stem and partially extend out of the tool stem for selectively engaging with the handle and for selectively anchoring the handle to the tool stem, a tool shank including a first end having a non-circular socket opening formed therein and having at least one curved surface formed therein for pivotally receiving the spatial engaging member of the tool stem and for engaging with the flat surface of the non-circular engaging member of the tool stem and for allowing the tool shank to be selectively tilted relative to a longitudinal axis of the tool stem to different angular position and also for allowing the tool shank to be rotated by the tool stem even when the tool stem and the tool shank are tilted relative to each other, and the tool shank including a second end for coupling to a tool member, a retaining member attached to the tool shank and received in the peripheral depression of the tool stem for selectively engaging with the spatial engaging member of the tool stem and for preventing the spatial engaging member of the tool stem from being disengaged from the tool shank, at least one magnetic member disposed in the tool shank for attracting the spatial engaging member of the tool stem to the tool shank, a control ferrule slidably engaged onto the tool shank for being held by a user, and the control ferrule being slidable and selectively engageable onto the tool stem for retaining the tool shank in line with the longitudinal axis of the tool stem and for preventing the tool shank from being tilted relative to the tool stem to other angular position, and a limiting device for limiting the control ferrule to slide relative to the tool shank.

The limiting device includes a retaining ring engaged onto the tool shank and engageable with the control ferrule for limiting the control ferrule to slide relative to the tool shank. The control ferrule includes two limiting grooves formed therein for engaging with the retaining ring and for limiting the control ferrule to move relative to the tool shank and for maintaining the control ferrule either in engagement with only the tool shank or in engagement with both the tool shank and the tool stem.

The tool shank includes a compartment formed therein to receive a barrel, and the magnetic member is engaged into the barrel. The handle includes a number of sockets formed therein for receiving driven members.

The tool shank includes a second magnetic member disposed in the tool shank for attracting the tool member to the tool shank. The tool shank includes another compartment formed therein to receive another barrel, and the second magnetic member is engaged into the barrel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
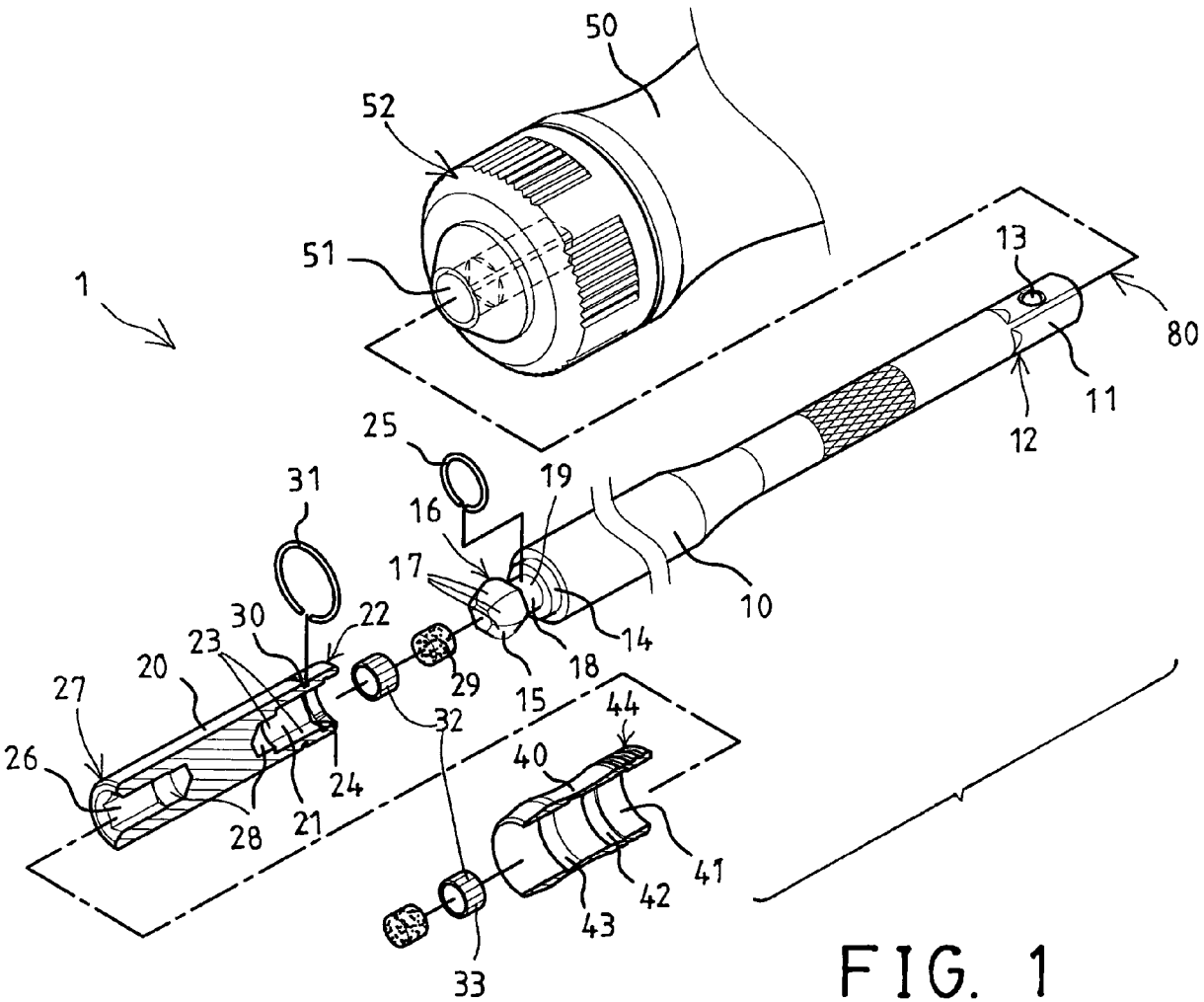
FIG. 1 is an exploded view of a driving tool in accordance with the present invention.
Figure 2:
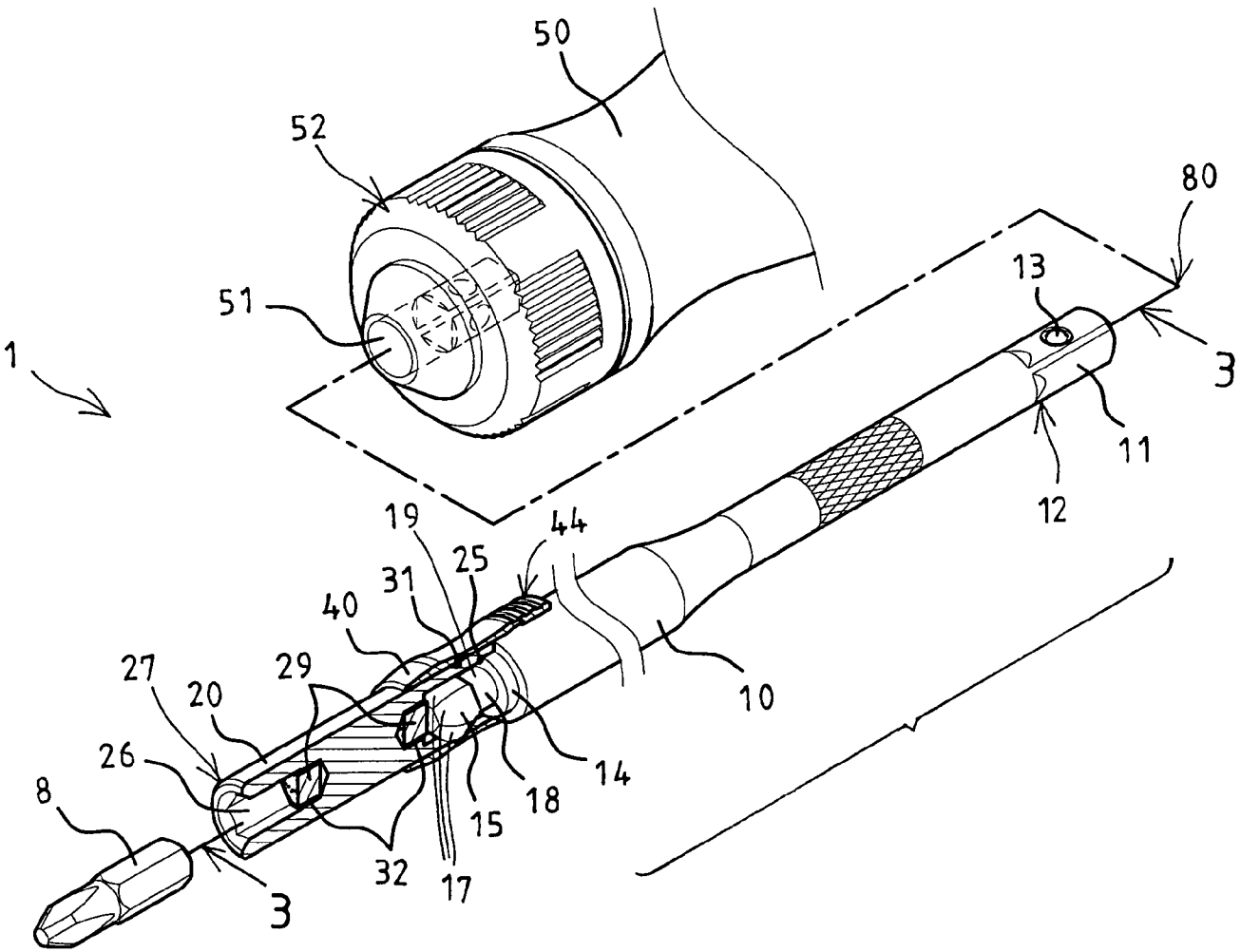
FIG. 2 is a partial exploded view illustrating the operation of the driving tool.

Referring to the drawings, and initially to FIGS. 1-4, a driving tool 1 in accordance with the present invention may be a wrench or a screwdriver and comprises a tool body or tool stem 10 including an extension 11 extended or provided on one end portion 12 thereof for selectively engaging with or into a receiving cavity 51 of a handle 50 of such as a screwdriver, and a spring-biased projection device 13 engaging with or into the extension 11 of the tool stem 10 for selectively engaging with the handle 50 and for detachably anchoring or positioning the extension 11 of the tool stem 10 to the handle 50. The tool stem 10 includes a diameter reduced anchoring segment 14 and a rounded and three-dimensional or spatial engaging member 15 formed or provided on the other end 16 thereof.

Figure 5:
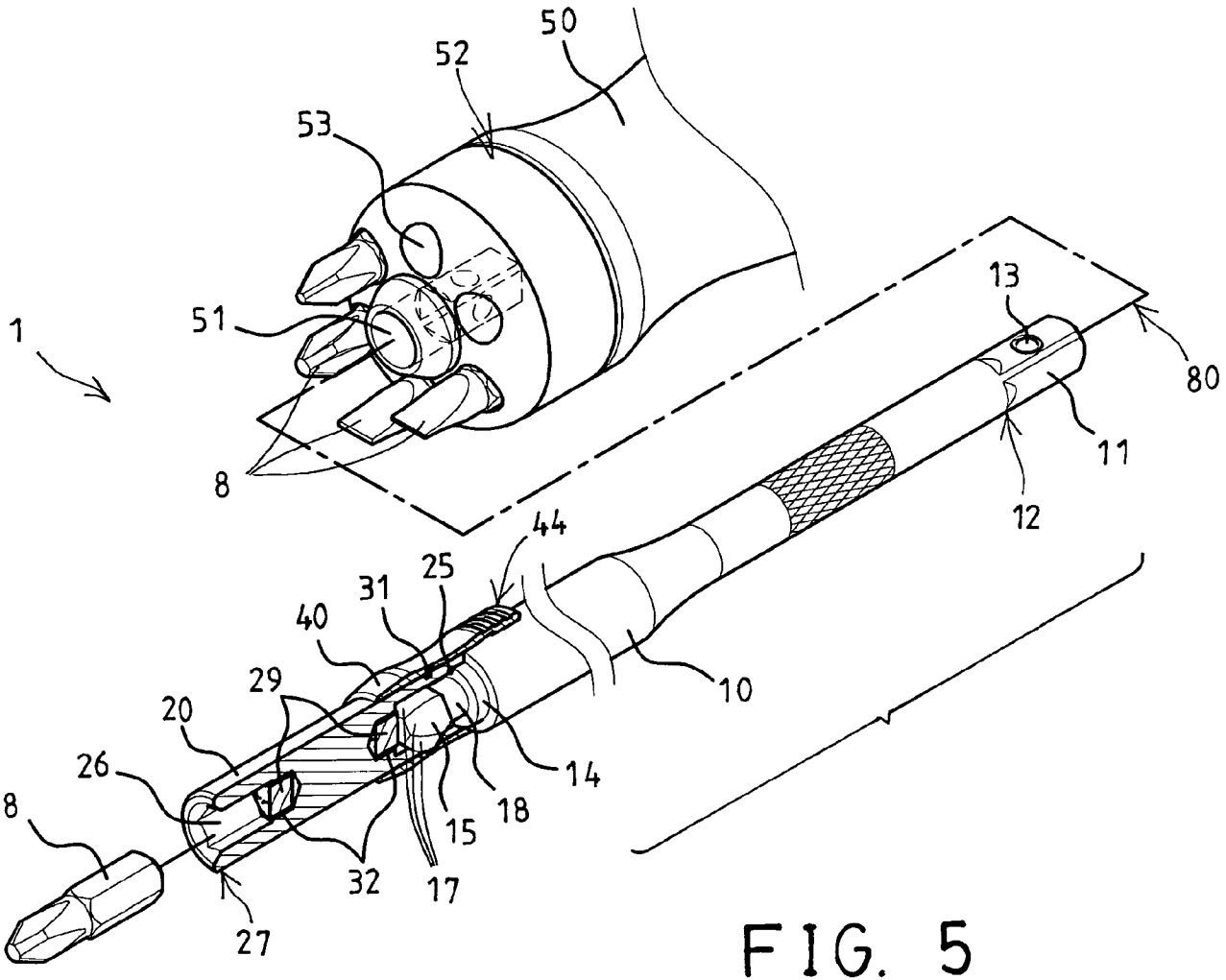
FIG. 5 is a partial exploded view similar to FIG. 2, illustrating the other application of the driving tool.

The handle 50 may include a typical ratchet control device 52 attached thereto or coupled to the free end portion thereof for allowing the tool stem 10 to be rotated or driven by the handle 50 in one direction and for allowing the tool stem 10 to be freely rotatable in the other direction or in the reverse direction. The typical ratchet control device 52 is not related to the present invention and will not be described in further details. The receiving cavity 51 of the handle 50 may be formed or provided in the ratchet control device 52, and the ratchet control device 52 may further include one or more sockets 53 formed therein (FIG. 5) for receiving tool or driven members 8 therein.

The spatial engaging member 15 of the tool stem 10 includes a non-circular cross section, such as a hexagonal or octangular cross section having one or more curved or flat surfaces 17 formed in outer peripheral portion thereof. The tool stem 10 further includes a peripheral depression 18 formed therein, such as formed in the middle portion thereof and located between the spatial engaging member 15 and the tool stem 10, for forming or defining a narrowed neck portion 19. The neck portion 19 of the tool stem 10 includes an outer diameter smaller than that of the tool stem 10 and the diameter reduced anchoring segment 14 and the spatial engaging member 15 of the tool stem 10.

A tool shank 20 includes a socket opening 21 formed in one end portion 22 thereof (FIG. 1) for slidably and/or rotatably or pivotally receiving the spatial engaging member 15 of the tool stem 10 and for allowing the tool shank 20 to be selectively tilted or slanted or pivoted relative to the longitudinal axis 80 (FIG. 2) of the tool stem 10 (FIG. 4) when the rounded or spatial engaging member 15 of the tool stem 10 is engaged in the socket opening 21 of the tool shank 20. The socket opening 21 of the tool stem 10 includes a non-circular cross section, such as a hexagonal cross section having one or more flat surfaces 23 formed therein for engaging with the corresponding flat surfaces 17 of the tool shank 20 and for allowing the tool shank 20 to be tilted or pivoted relative to the longitudinal axis 80 of the spatial engaging member 15 or of the tool stem 10 to different angular position.

The tool shank 20 also may be rotated or driven by the tool stem 10 with the spatial engaging member 15 and/or with the engagement of the curved surfaces 17 of the spatial engaging member 15 of the tool stem 10 with the flat surfaces 23 of the tool shank 20 even when the tool shank 20 is slanted or tilted relative to the longitudinal axis 80 of the tool stem 10 to different angular position. The one end portion 22 of the tool shank 20 may be selectively engaged with the peripheral depression 18 of the tool stem 10 (FIG. 4) for allowing the tool shank 20 to be suitably tilted or pivoted relative to the longitudinal axis 80 of the spatial engaging member 15 or of the tool stem 10 to different or selected angular position.

The tool shank 20 further includes a peripheral groove 24 formed in the inner peripheral portion thereof for receiving or engaging with a clamping or retaining member 25 therein, the retaining member 25 may be slidably engaged in the peripheral depression 18 of the tool stem 10 and may be selectively engaged with the spatial engaging member 15 and the tool stem 10 for anchoring or securing the tool shank 20 to the tool stem 10 and for preventing the tool shank 20 from being disengaged from the spatial engaging member 15 of the tool stem 10. The formation or the provision of the peripheral depression 18 in the tool stem 10 allows the tool shank 20 to be suitably and selectively slanted or tilted or pivoted relative to the longitudinal axis 80 of the tool stem 10 to different angular position.

The tool shank 20 further includes a coupling device 26, such as an engaging hole 26 provided or formed in the other end 27 thereof for receiving and for engaging with and for coupling to various driven members 8 therein, such as tool bits 8 (FIGS. 2-4), or for engaging with and for coupling to various driving tools (not shown), or the like which may be rotated or driven by the tool stem 10 with the tool shank 20. The driven members 8 include a non-circular or hexagonal structure or the like for engaging with the engaging hole 26 of the tool shank 20 and thus for allowing the screwdriver bit or driven member 8 to be rotated or driven by the tool shank 20.

The tool shank 20 further includes one or more (such as two) compartments 28 formed therein and communicating with the socket opening 21 and the engaging hole 26 of the tool shank 20 respectively each for receiving or attaching or securing a magnetic member 29 therein which may be used to attract the tool shank 20 to the spatial engaging member 15 of the tool stem 10 and/or to attract the screwdriver bit or driven member 8 to the tool shank 20 and/or to the tool stem 10. Alternatively, the magnetic member 29 may also be attached to the spatial engaging member 15 of the tool stem 10 for attracting the tool shank 20 to the spatial engaging member 15 of the tool stem 10. The tool shank 20 further includes a peripheral groove 30 formed in the outer peripheral portion thereof for receiving another clamping or retaining member 31 therein.

For solidly attaching or securing the magnetic member 29 to the tool shank 20, the magnetic member 29 may first be engaged into a barrel 32, and the barrel 32 may include a rough or serrated outer peripheral surface 33 formed on the outer peripheral portion thereof for engaging into the compartment 28 of the tool shank 20 and for allowing the barrel 32 and thus the magnetic member 29 to be easily and quickly attached or secured to the tool shank 20 by forcing the barrel 32 into the tool shank 20 and with a force-fitted engagement.

Figure 6:
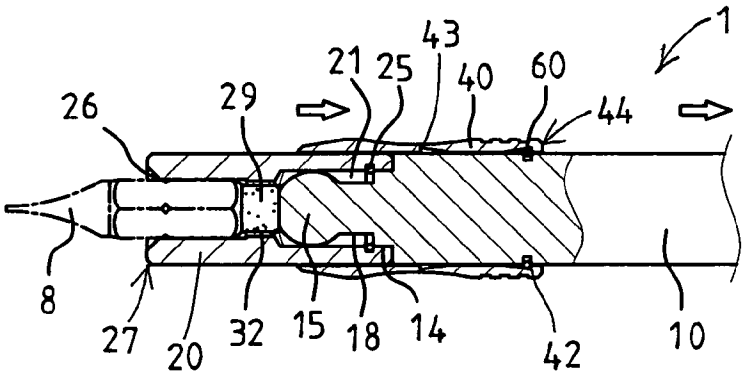
FIGS. 6, 7 are partial cross sectional views illustrating the further application of the driving tool.
Figure 7:
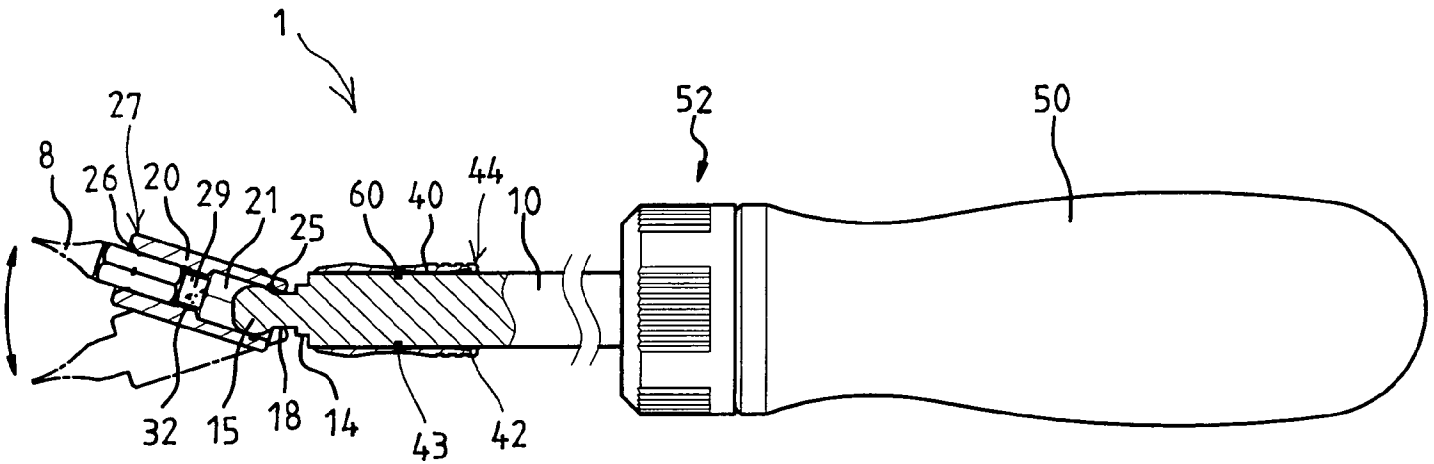

A sleeve or control ferrule 40 is slidably or rotatably attached or engaged onto the tool shank 20 or includes a bore 41 formed therein for slidably receiving the tool shank 20, and includes two peripheral and/or ratchet limiting grooves 42, 43 formed therein and located closer to one end 44 thereof and communicating with the bore 41 of the control ferrule 40 for receiving or engaging with the clamping or retaining ring 31 and for limiting the control ferrule 40 to move or to slide relative to the tool shank 20 and also for preventing the control ferrule 40 from being disengaged from the tool shank 20. As shown in FIGS. 6 and 7, without the retaining ring 31, the tool stem 10 may include another clamping or retaining member or retaining ring 61 attached or secured on the outer peripheral portion thereof for engaging with either of the ratchet limiting grooves 42, 43 of the control ferrule 40 and for limiting the control ferrule 40 to move or to slide relative to the tool shank 20 and the tool stem 10, and also for preventing the control ferrule 40 from being disengaged from the tool stem 10.

Figure 4:
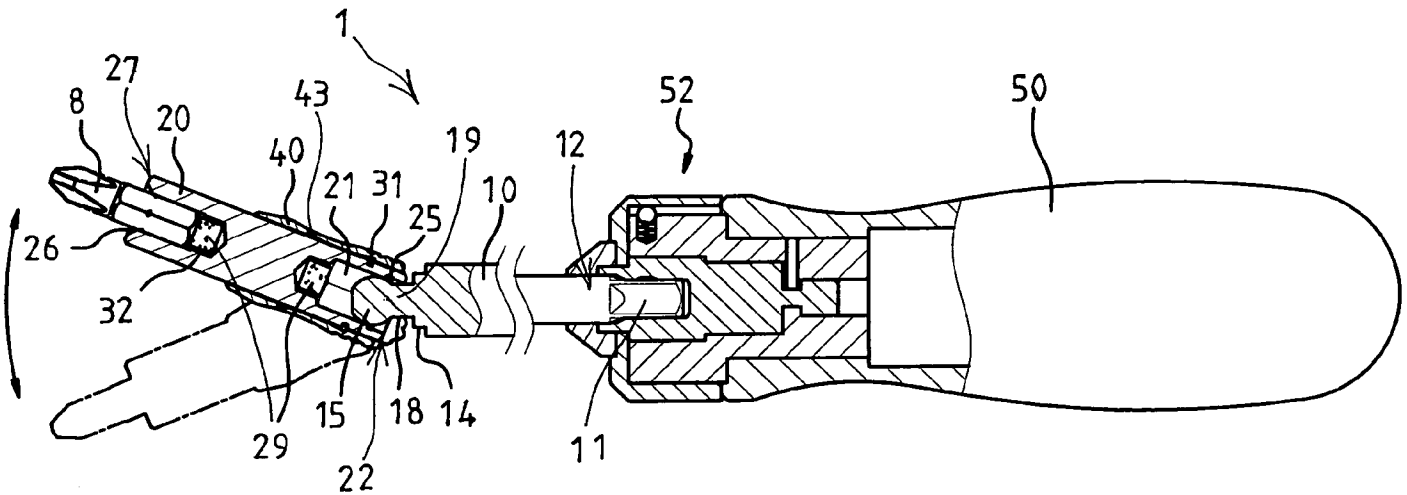
FIG. 4 is a partial cross sectional view similar to FIG. 3, illustrating the operation of the driving tool.

In operation, as shown in FIG. 4, the tool shank 20 and the control ferrule 40 may be selectively tilted or slanted or pivoted relative to the longitudinal axis 80 of the tool stem 10 when the rounded or spatial engaging member 15 of the tool stem 10 is engaged in the socket opening 21 of the tool shank 20 and when the control ferrule 40 is disengaged or separated from the tool stem 10 for allowing the tool stem 10 of driving tool 1 to be rotated or driven or worked or operated in tiny or narrower working spaces.

Figure 3:
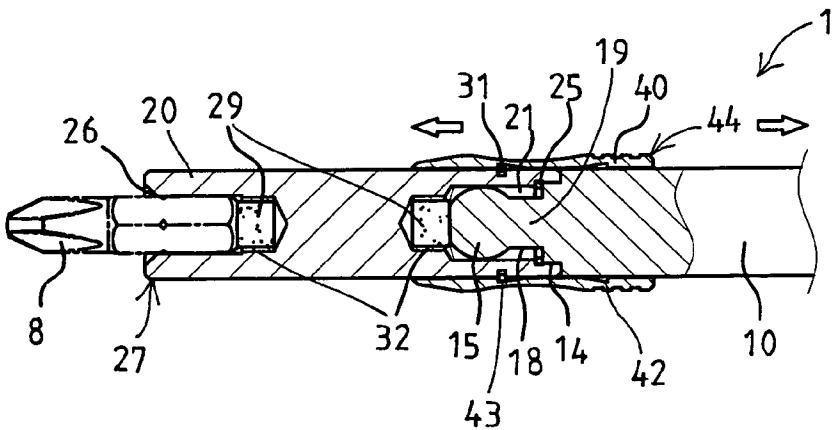
FIG. 3 is a partial cross sectional view of the driving tool, taken along lines 3-3 of FIG. 2.

As shown in FIG. 3, when the one end 44 of the control ferrule 40 is selectively engaged with or onto the other end 16 of the tool stem 10, and/or when the one end 22 of the tool shank 20 is engaged with or onto the anchoring segment 14 of the tool stem 10, the tool shank 20 may be stably or solidly anchored or secured or coupled to the tool stem 10 and in line with the longitudinal axis 80 of the tool stem 10, to prevent the tool shank 20 and the control ferrule 40 from being slanted or tilted or pivoted relative to the longitudinal axis 80 of the tool stem 10 and to allow the tool shank 20 to be retained in line with the longitudinal axis 80 of the tool stem 10, and thus to allow the tool shank 20 to be selectively and solidly and effectively rotated or driven by the tool stem 10.

The clamping or retaining ring 31 of the tool shank 20 may be selectively received or engaged with the peripheral and/or ratchet limiting grooves 42, 43 of the control ferrule 40 for limiting the control ferrule 40 to move or to slide relative to the tool shank 20 and for maintaining the control ferrule 40 in engagement with only the tool shank 20 and to allow the tool shank 20 and the control ferrule 40 to be tilted or slanted or pivoted relative to the longitudinal axis 80 of the tool stem 10; or for maintaining the control ferrule 40 in engagement with both the tool shank 20 and the tool stem 10 and to allow the tool shank 20 to be stably or solidly anchored or secured or coupled to the tool stem 10 and in line with the longitudinal axis 80 of the tool stem 10. The clamping or retaining ring 31 of the tool shank 20 and the peripheral and/or ratchet limiting grooves 42, 43 of the control ferrule 40 may thus be used or acted as a limiting means for limiting the control ferrule 40 to move or to slide relative to the tool shank 20.

Accordingly, the driving tool in accordance with the present invention may be provided for connecting a tool shank or a fastener or a work piece or a driven member to a tool stem and for allowing the tool member or the fastener or the work piece or the driven member to be selectively secured to the tool stem and to be driven by the tool stem or to be selectively tiltable or slantable relative to the tool stem to various angular positions, and to allow the tool stem to be rotated or driven or worked or operated in tiny or narrower working spaces.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving tool comprising:

a tool stem including an extension extended from a first end thereof, and a non-circular spatial engaging member provided on a second end thereof and having at least one flat surface formed therein, and including a peripheral depression formed between said tool stem and said spatial engaging member for forming a neck portion which includes an outer diameter smaller than that of said tool stem and said spatial engaging member, a handle including a receiving cavity formed therein for selectively receiving said extension of said tool stem, a spring-biased projection device engaged in said extension of said tool stem and partially extend out of said tool stem for selectively engaging with said handle and for selectively anchoring said handle to said tool stem, a tool shank including a first end having a non-circular socket opening formed therein and having at least one curved surface formed therein for pivotally receiving said spatial engaging member of said tool stem and for engaging with said at least one flat surface of said non-circular engaging member of said tool stem and for allowing said tool shank to be selectively tilted relative to a longitudinal axis of said tool stem to different angular position and also for allowing said tool shank to be rotated by said tool stem even when said tool stem and said tool shank are tilted relative to each other, and said tool shank including a second end for coupling to a tool member, said tool shank including a first compartment formed therein and communicating with said socket opening of said tool shank to receive a first barrel, and including a second compartment formed therein and communicating with said engaging hole of said tool shank to receive a second barrel, a retaining member attached to said tool shank and received in said peripheral depression of said tool stem for selectively engaging with said spatial engaging member of said tool stem and for preventing said spatial engaging member of said tool stem from being disengaged from said tool shank, at least one magnetic member disposed in said first barrel of said tool shank for attracting said spatial engaging member of said tool stem to said tool shank, a second magnetic member disposed in said second barrel of said tool shank for attracting the tool member to said tool shank, a control ferrule slidably engaged onto said tool shank for being held by a user, and said control ferrule being slidable and selectively engageable onto said tool stem for retaining said tool shank in line with said longitudinal axis of said tool stem and for preventing said tool shank from being tilted relative to said tool stem to other angular position, a retaining ring engaged onto said tool shank and engageable with said control ferrule for limiting said control ferrule to slide relative to said tool shank, and said control ferrule including two limiting grooves formed therein for engaging with said retaining ring and for limiting said control ferrule to move relative to said tool shank and for maintaining said control ferrule either in engagement with only said tool shank or in engagement with both said tool shank and said tool stem.

2. The driving tool as claimed in claim 1, wherein said handle includes a plurality of sockets formed therein for receiving driven members.

* * * * *